US011168626B2

(12) United States Patent
Ahn et al.

(10) Patent No.: US 11,168,626 B2
(45) Date of Patent: Nov. 9, 2021

(54) METHOD FOR REMOVING RESIDUAL PURGE GAS

(71) Applicants: Hyundai Motor Company, Seoul (KR); Kia Motors Corporation, Seoul (KR)

(72) Inventors: Tae-Ho Ahn, Incheon (KR); Jeong-Ho Seo, Seoul (KR); Young-Kyu Oh, Gwacheon-si (KR)

(73) Assignees: HYUNDAI MOTOR COMPANY, Seoul (KR); KIA MOTORS CORPORATION, Seoul (KR)

( * ) Notice: Subject to any disclaimer, the term of this patent is extended or adjusted under 35 U.S.C. 154(b) by 34 days.

(21) Appl. No.: 16/701,413

(22) Filed: Dec. 3, 2019

(65) Prior Publication Data

US 2020/0271065 A1 Aug. 27, 2020

(30) Foreign Application Priority Data

Feb. 26, 2019 (KR) ..... 10-2019-0022352

(51) Int. Cl.

| | |
|---|---|
| ***F02D 41/00*** | (2006.01) |
| ***F02M 25/08*** | (2006.01) |
| ***F02M 35/10*** | (2006.01) |
| ***F02M 26/47*** | (2016.01) |

(52) U.S. Cl.

CPC ..... *F02D 41/0047* (2013.01); *F02M 25/0836* (2013.01); *F02M 25/0854* (2013.01); *F02M 25/0872* (2013.01); *F02M 26/47* (2016.02); *F02M 35/10222* (2013.01); *F02M 35/10373* (2013.01)

(58) Field of Classification Search

CPC ..... F02D 41/0047; F02M 26/47; F02M 25/0836; F02M 25/0854; F02M 25/0872; F02M 35/10222; F02M 35/10373

USPC ..... 123/520

See application file for complete search history.

(56) References Cited

U.S. PATENT DOCUMENTS

| | | | | |
|---|---|---|---|---|
| 5,676,118 | A * | 10/1997 | Saito | F02D 41/0045 123/520 |
| 7,464,698 | B2 * | 12/2008 | Maegawa | F02D 41/0045 123/519 |
| 2002/0129797 | A1 * | 9/2002 | Hayashi | F02D 41/0032 123/520 |
| 2002/0129802 | A1 * | 9/2002 | Hayashi | F02D 41/0045 123/698 |
| 2002/0162457 | A1 * | 11/2002 | Hyodo | B01D 53/0454 96/109 |

(Continued)

FOREIGN PATENT DOCUMENTS

KR 20030050120 A 6/2003

*Primary Examiner* — David Hamaoui
*Assistant Examiner* — John D Bailey
(74) *Attorney, Agent, or Firm* — Slater Matsil, LLP

(57) ABSTRACT

The present disclosure relates to a method for removing residual purge gas in operating an active purge system and includes determining evaporation gas purge stop in a control unit, closing a PCSV mounted on a purge line connecting a canister and an intake pipe, and determining whether all of the evaporation gas flowed into the intake pipe is flowed into a combustion chamber, so that all of the evaporation gas flowed into an intake pipe during travelling can be flowed into and combusted in the combustion chamber.

18 Claims, 3 Drawing Sheets

(56) References Cited

U.S. PATENT DOCUMENTS

| | | | | |
|---|---|---|---|---|
| 2003/0000510 | A1* | 1/2003 | Inoue | F02D 41/0042 123/698 |
| 2003/0110836 | A1 | 6/2003 | Cho | |
| 2003/0196645 | A1* | 10/2003 | Kojima | F02M 25/089 123/520 |
| 2007/0277789 | A1* | 12/2007 | Ishikawa | F02D 41/0045 123/520 |
| 2017/0234269 | A1* | 8/2017 | Pursifull | F02M 25/08 123/520 |
| 2018/0274492 | A1* | 9/2018 | Uchida | F02D 41/0042 |
| 2018/0347511 | A1* | 12/2018 | Makino | F02D 41/0032 |
| 2019/0101082 | A1* | 4/2019 | Sanuma | F02M 25/0836 |
| 2019/0113007 | A1* | 4/2019 | Kato | F02D 41/0045 |
| 2019/0249621 | A1* | 8/2019 | Kugo | F02M 25/0809 |
| 2019/0249623 | A1* | 8/2019 | Kugo | F02D 41/22 |
| 2019/0331036 | A1* | 10/2019 | Asanuma | F02D 41/003 |
| 2019/0331064 | A1* | 10/2019 | Asanuma | F02M 25/08 |

* cited by examiner

METHOD FOR REMOVING RESIDUAL PURGE GAS

CROSS-REFERENCE TO RELATED APPLICATIONS

This application claims priority to Korean Patent Application No. 10-2019-0022352, filed on Feb. 26, 2019, which is incorporated herein by reference in its entirety.

TECHNICAL FIELD

The present disclosure relates to a method for removing residual purge gas in operating an active purge system.

BACKGROUND

Depending on the atmospheric pressure and temperature, evaporation gas is generated inside a fuel tank. The evaporation gas is adsorbed to a canister and then purged by being injected into an intake pipe. The evaporation gas moves from the canister to the intake pipe due to the negative pressure generated by the intake flowing into the intake pipe, and is combusted in a combustion chamber together with the intake and fuel.

However, in the case of a hybrid vehicle, an engine is stopped depending on a vehicle speed during operation. When the engine stops during purging the evaporation gas, the evaporation gas flowed into the intake pipe is not combusted in the combustion chamber, and there is a high possibility of leaking into the atmosphere.

The foregoing is intended merely to aid in the understanding of the background of the present disclosure, and is not intended to mean that the present disclosure falls within the purview of the related art that is already known to those skilled in the art.

SUMMARY

The present disclosure relates to a method for removing residual purge gas in operating an active purge system. Particular embodiments of the present disclosure relate to a method for removing residual purge gas in operating an active purge system that prevents evaporation gas from remaining in an intake and intake manifold.

Embodiments of the present invention can provide a method for removing residual purge gas in operating an active purge system that allows all of the evaporation gas flowed into the intake pipe during operation to be flowed into and combusted in the combustion chamber.

A method for removing residual purge gas in operating an active purge system of an exemplary embodiment of the present disclosure may determine that all of the evaporation gas flowed into an intake pipe through a PCSV (Pressure Control Solenoid Valve) is flowed into a combustion chamber when an integrated value of the amount of an air supplied to the combustion chamber after the PCSV is closed is equal to or greater than a predetermined value.

A method for removing residual purge gas in operating an active purge system of an exemplary embodiment of the present disclosure may determine that all of the evaporation gas flowed into an intake pipe through a PCSV is flowed into a combustion chamber when the time elapsed after the PCSV is closed exceeds a predetermined value.

A method for removing residual purge gas in operating an active purge system of an exemplary embodiment of the present disclosure may include determining evaporation gas purge stop in a control unit; closing a PCSV mounted on a purge line connecting a canister and an intake pipe; and determining whether all of the evaporation gas flowed into the intake pipe is flowed into a combustion chamber.

Further, the PCSV may be ready to operate again after a predetermined critical time elapses after it is determined that all of the evaporative gas has flowed into the combustion chamber.

Furthermore, an active purge pump may be mounted on the purge line so as to be located between the PCSV and the canister; and the control unit may adjust a rotation speed of the active purge pump, an opening amount of the PCSV and an opening and closing timing of the PCSV based on signal received from a sensor mounted on the canister, signals received from a sensor mounted on the intake pipe and a sensor mounted on an exhaust pipe connected with the combustion chamber, and signals received from a plurality of sensors mounted on the purge line.

Additionally, the determining whether all of the evaporation gas is flowed into the combustion chamber determines whether all of the evaporation gas may be flowed into the combustion chamber based on an evaporation gas remaining signal.

In addition, the evaporation gas remaining signal may be derived by comparing whether the integrated value of the amount of an air supplied to the combustion chamber after the PCSV is closed is equal to or greater than a predetermined value.

Also, the evaporation gas remaining signal may be derived by comparing the value obtained by subtracting an EGR (exhaust gas recirculation) gas amount from the integrated value of the air amount with an effective intake system volume, which is the volume of the intake actually flowed into the combustion chamber by RPM or LOAD.

Further, the evaporation gas remaining signal may be derived based on a delay time derived from a delay model function modeling the flow until the evaporation gas is flowed from the intake pipe to the intake manifold and a density of the evaporation gas.

Furthermore, the evaporation gas remaining signal may be derived based on a delay time derived from a delay model function modeling the flow until the evaporation gas is flowed from the intake pipe to the intake manifold and concentration factors of the evaporation gas.

In addition, the engine is stopped when it is determined that all of the evaporation gas is flowed into the combustion chamber.

BRIEF DESCRIPTION OF THE DRAWINGS

The above and other objects, features and advantages of the present disclosure will be more clearly understood from the following detailed description taken in conjunction with the accompanying drawings, in which.

DETAILED DESCRIPTION OF ILLUSTRATIVE EMBODIMENTS

Hereinafter, a flowchart of a method for removing residual purge gas in operating an active purge system according to an exemplary embodiment of the present disclosure will be described in detail with reference to accompanying drawings.

Figure 1:
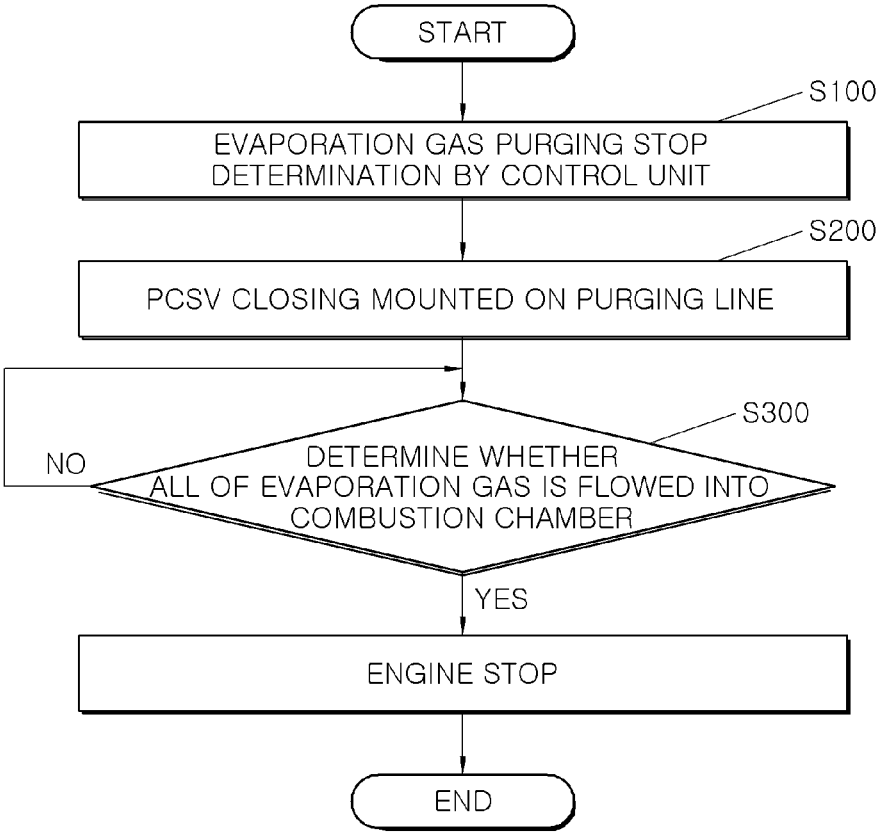
FIG. 1 is a flowchart of a method for removing residual purge gas in operating an active purge system of an exemplary embodiment of the present disclosure.
Figure 2:
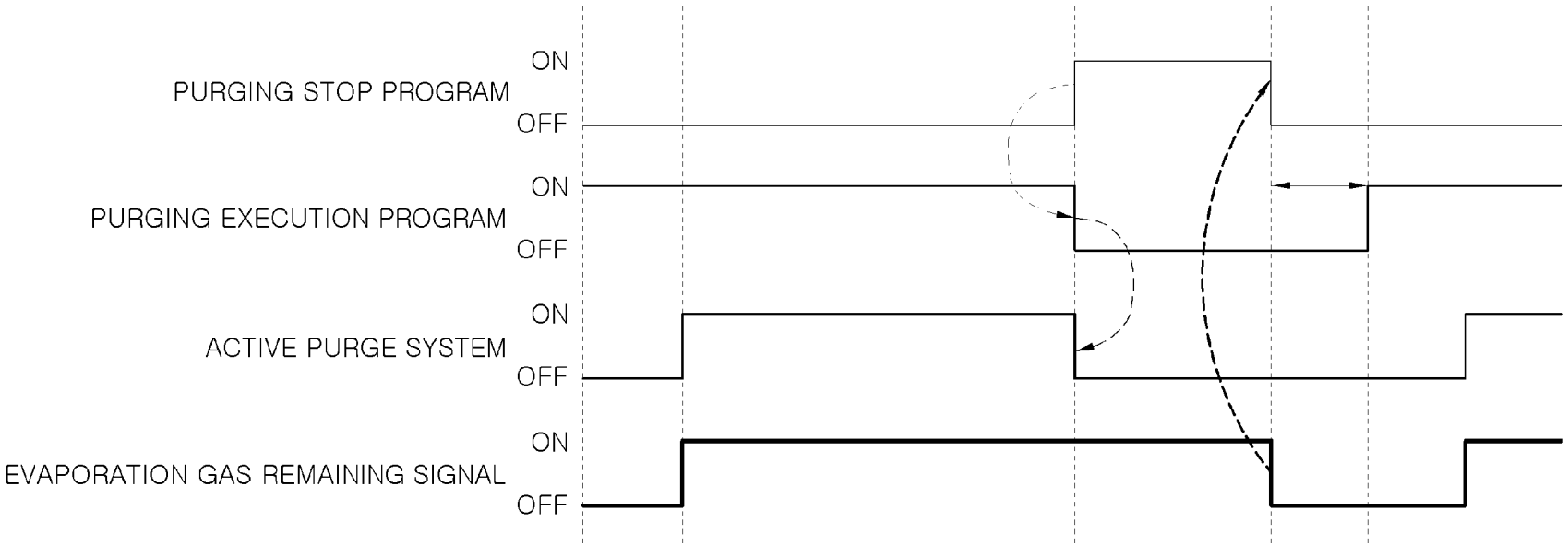
FIG. 2 is an on-off graph of a control signal according to the method for removing residual purge gas in operating the active purge system of FIG. 1.
Figure 3:
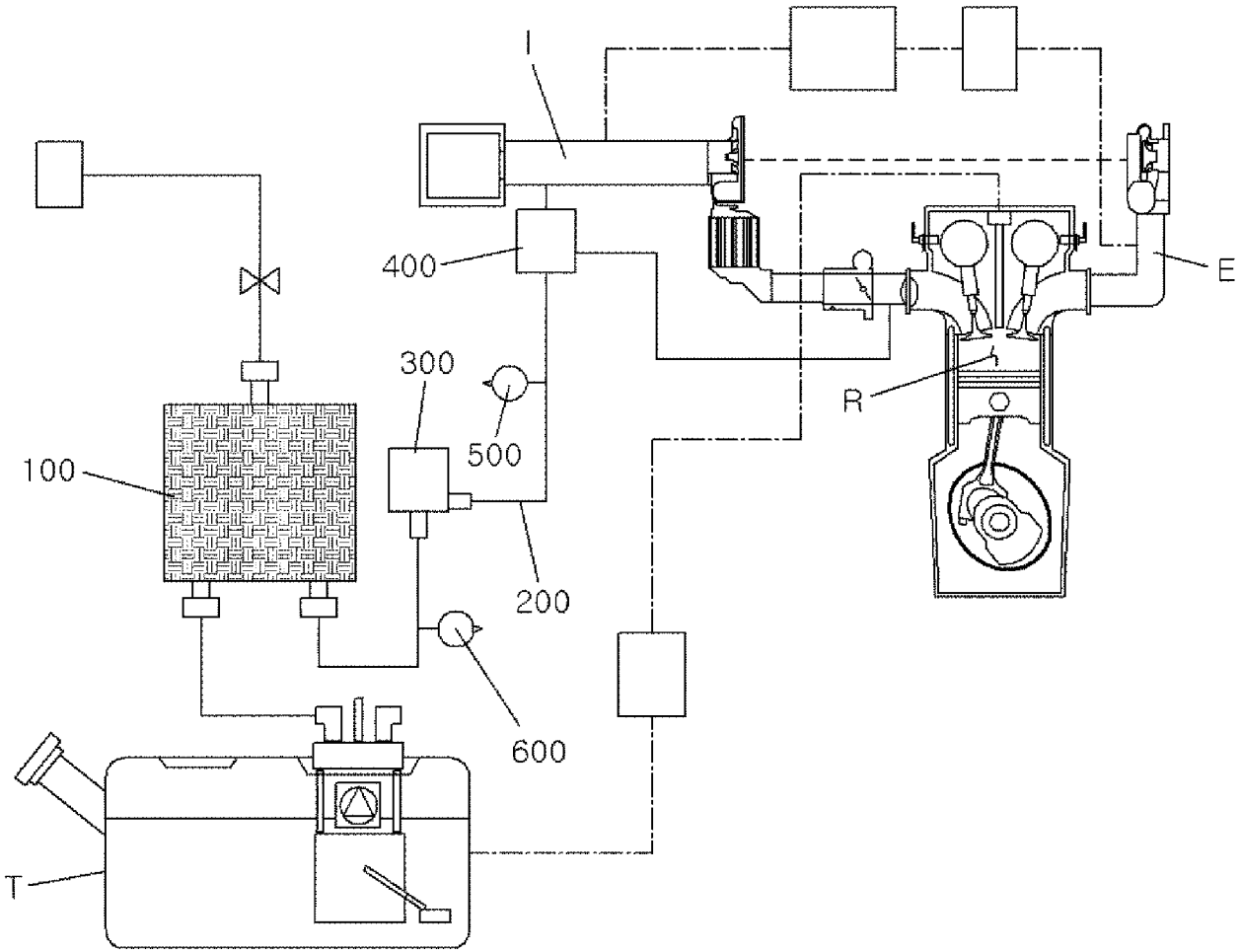
FIG. 3 is an example drawing of an active purge system to which a method for removing residual purge gas in operating an active purge system of FIG. 1 is applied.

As shown in FIGS. 1 to 3, a method for removing residual purge gas in operating an active purge system according to an exemplary embodiment of the present disclosure may include, a step S100 of determining, by a control unit, evaporation gas purging stop, a step S200 of closing a Pressure Control Solenoid Valve (PCSV) 400 mounted on a purge line 200 connecting a canister 100 and an intake pipe I, and a step S300 of determining whether all of the evaporation gas flowed into the intake pipe I is flowed into a combustion chamber R.

The control unit may include a hybrid control unit for controlling the operation of a hybrid vehicle and an engine control unit for controlling the operation of an engine. The control unit may include an evaporation gas purge execution program and an evaporation gas purge stop program. The control unit may perform the evaporation gas purge stop program and the evaporation gas purge execution program based on signals received from various sensors.

The evaporation gas purge execution program may be performed based on signals received from a plurality of sensors mounted on a pedal, the canister 100, the purge line 200, the intake pipe I and an exhaust pipe E. The evaporation gas purge execution program, as shown in FIG. 3, may control the operation of an active purge system. As shown in FIG. 3, the active purge system may include the canister 100 that adsorbs evaporation gas from a fuel tank T, the purge line 200 that connects the canister 100 and the intake pipe I, the PCSV 400 mounted on the purge line 200 between the canister 100 and the intake pipe I, an active purge pump 300 mounted on the purge line 200 between the PCSV 400 and the canister 100, and a first pressure sensor 500 and a second pressure sensor 600 mounted on the purge line 200 between the canister 100 and the active purge pump 300 and between the active purge pump 300 and the PCSV 400.

The evaporation gas is compressed in the purge line between the active purge pump 300 and the PCSV 400 through adjustment of the rotation speed of the active purge pump 300 and opening and closing timing control of the PCSV 400 and opening amount adjustment of the PCSV 400, and then can be forcibly injected into the intake pipe I. Thus, evaporator gas can be injected into the intake pipe I even though the intake pipe I is equipped with a supercharger and the internal pressure of the intake pipe I is equal to or higher than the atmospheric pressure. Particularly, through the pressure generated by compressing the evaporation gas between the active purge pump 300 and the PCSV 400 among the purge line and the opening and closing timing and opening control of the PCSV 400, it is possible to the amount of the evaporation gas flowing into the intake pipe I from the purge line 200. The rotation speed control of the active purge pump 300 can produce a pressure difference between the front and rear ends of the active purge pump 300. The hydrocarbon concentration of the evaporation gas concentrated between the active purge pump 300 and the PCSV 400 by the pressure difference can be calculated. The hydrocarbon density can be calculated from the hydrocarbon concentration and the fuel amount supplied to the combustion chamber can be controlled based on the hydrocarbon density.

The evaporation gas purge execution program may estimate the purge flow rate, which is the amount of evaporation gas to be removed from the canister 100, based on the signal received from the sensor mounted on the canister 100. The evaporation gas purge execution program may calculate a target purge flow rate based on the intake amount, fuel injection amount, and purge flow rate in the current running state. The target purge flow rate is the amount that should be flowed from the purge line 200 into the intake pipe I to satisfy the purge flow rate. In addition to calculate the target purge flow rate, the pressure between the active purge pump 300 and the PCSV 400 in the purge line to meet the target purge flow rate, the rotation speed of the active purge pump 300, the opening and closing timing of the PCSV 400, and the opening amount of the PCSV 400 may be derived. Additionally, as the target purge flow rate is forcibly flowed into the intake pipe I, the correction value of the fuel injection amount being injected into the combustion chamber R may be also derived, considering that hydrocarbon is additionally supplied to the combustion chamber R.

The evaporation gas purge stop program may be executed at the moment of determining the engine stop for the driving control or operation control in the control unit. The step S100 of determining whether the evaporation gas purge stops or not may be performed at the same time of executing the evaporation gas purge stop program. The evaporation gas purge stop program may stop the evaporation gas purge execution program. When it is determined that all of the evaporation gas combustion is flowed into combustion chamber R in the step S300 of determining whether all the evaporation gas flowed into the intake pipe I is flowed into the combustion chamber R, the evaporation gas purge stop program is stopped. The engine may be stopped together with the stop of the evaporation gas purge stop program. After the evaporation gas purge stop program is stopped, the evaporation gas purge execution program is activated after the critical time is elapsed.

Even if the engine stop is determined, since the engine is stopped after it is determined that all of the evaporation gas is flowed into the combustion chamber R, purge missing of the evaporation gas flowed into the intake pipe I due to the engine stop may be prevented. Since the purge missing of the evaporation gas is prevented, the evaporation gas may be prevented from leaking into the atmosphere.

In the step S200 of closing the PCSV 400, it may be repeatedly checked whether the amount of evaporation gas collected in the canister 100 is equal to or less than an appropriate value. When it is confirmed that the amount of evaporation gas collected in the canister 100 is equal to or less than an appropriate value, the PCSV 400 may be closed. In the step S200 of closing the PCSV 400, the control unit may check whether the purge flow rate is deviated from the canister 100 based on the signal received from the sensor mounted on the canister 100. Together with this, it may be confirmed that the target purge flow rate is forcibly injected from the purge line 200 to the intake pipe I based on signals continuously received from the first pressure sensor 500 and second pressure sensor 600 mounted on the purge line 200. The control unit may close the PCSV 400 when it is confirmed that both the purge flow rate and the target purge flow rate are satisfied.

In the step S300 of determining whether all of the evaporation gas is flowed into the combustion chamber R, it may be determined whether all of the evaporation gas is flowed into the combustion chamber R based on the evaporation gas remaining signal. The evaporation gas remaining signal, as shown in FIG. 2, may be generated as OFF or ON in the control unit. When the evaporation gas remaining signal is OFF, the evaporation gas purge stop program may be stopped. As described above, as the evaporation gas purge stop program is stopped, the engine is stopped. After the evaporation gas purge stop program is stopped and a critical time is elapsed, the evaporation gas purge execution program is performed.

The evaporation gas remaining signal is changed from ON to OFF when the integrated value of the amount of air supplied to the combustion chamber R after the closing of the PCSV 400 is above the predetermined value or when the elapsed time after the closing of the PCSV 400 exceeds the predetermined value.

According to the exemplary embodiment, the evaporation gas remaining signal may be derived by comparing the value obtained by subtracting the EGR gas amount from the integrated value of the air amount and the effective intake system volume, which is the intake volume actually flowed into the combustion chamber R by RPM or LOAD. When the effective intake system volume is greater than the value obtained by subtracting the EGR gas amount from the integrated value of the air amount, the evaporation gas remaining signal is changed from ON to OFF.

According to another exemplary embodiment, the evaporation gas remaining signal may be derived based on the delay time derived from the delay model function modeling the flow until the evaporation gas is flowed from the intake pipe I into the intake manifold, and the density or concentration factors of the evaporation gas.

The evaporation gas remaining signal may be changed from ON to OFF when the value calculated by substituting the delay time and density into a specific formula is greater than or less than the predetermined value. Alternatively, the evaporation gas remaining signal may be changed from ON to OFF when the difference value between the delay time and density, and the value calculated by multiplying the delay time and the density is greater than or less than the predetermined value.

According to the method for removing residual purge gas in operating an active purge system of an exemplary embodiment of the present disclosure as configured above, all of the evaporation gas flowed into the intake pipe I during operation can be flowed into and combusted in the combustion chamber R.

Particularly, since it is determined whether all of the evaporation gas flowed into the intake pipe I after the PCSV 400 is closed is flowed into the combustion chamber R, the stopping point of the engine due to the control during the vehicle operation can be delayed after all of the evaporation gas is flowed into the combustion chamber R.

Therefore, Even if the engine is stopped due to the control during operation, the purge treatment of the evaporation gas flowed into to the intake pipe I is prevented from being missed. Evaporation gas that is missing the purge treatment is prevented from leaking into the atmosphere.

In accordance with the method for removing residual purge gas in operating the active purge system of an exemplary embodiment of the present disclosure as configured above, all of the evaporation gas flowed into the intake pipe during operation can be flowed into and combusted in the combustion chamber.

Particularly, since it is determined that all the evaporation gas flowed into the intake pipe is flowed into the combustion chamber after the PCSV is closed, the stopping point of the engine due to the control during the vehicle operation can be delayed after all of the evaporation gas is flowed into the combustion chamber.

Therefore, even if the engine is stopped due to control during operation, the purging treatment of the evaporation gas flowed into the intake pipe is prevented from being omitted. Evaporation gas that is missing the purge treatment is prevented from leaking into the atmosphere.

What is claimed is:

1. A method for removing residual purge gas in operating an active purge system, the method comprising:

determining an evaporation gas purge stop;

closing a PCSV (pressure control solenoid valve) mounted on a purge line connecting a canister and an intake pipe;

determining whether all evaporation gas flowed into the intake pipe through the PCSV has flowed into a combustion chamber when an amount of an air supplied to the combustion chamber after the PCSV is closed is equal to or greater than a first predetermined value or when a time elapsed after the PCSV is closed exceeds a second predetermined value; and stopping an engine when it is determined that all evaporation gas has flowed into the combustion chamber.

2. The method of claim 1, wherein the PCSV is ready to operate again after a predetermined critical time has elapsed after it is determined that all of the evaporation gas has flowed into the combustion chamber.

3. The method of claim 1, wherein an active purge pump is mounted on the purge line so as to be located between the PCSV and the canister, the method further comprising adjusting a rotation speed of the active purge pump, an opening amount of the PCSV and an opening and closing timing of the PCSV.

4. The method of claim 3, wherein the adjusting is based on signals received from a sensor mounted on the canister, a sensor mounted on the intake pipe, a sensor mounted on an exhaust pipe connected with the combustion chamber, and a plurality of sensors mounted on the purge line.

5. A method for removing residual purge gas in operating an active purge system, the method comprising:

determining an evaporation gas purge stop;

closing a PCSV (pressure control solenoid valve) mounted on a purge line connecting a canister and an intake pipe;

determining whether all evaporation gas flowed into the intake pipe through the PCSV has flowed into a combustion chamber when an amount of an air supplied to the combustion chamber after the PCSV is closed is equal to or greater than a first predetermined value or when a time elapsed after the PCSV is closed exceeds a second predetermined value, wherein determining whether all of the evaporation gas has flowed into the combustion chamber is based on an evaporation gas remaining signal; and stopping an engine when it is determined that all evaporation gas has flowed into the combustion chamber.

6. The method of claim 5, wherein the evaporation gas remaining signal is derived by comparing whether an amount of an air supplied to the combustion chamber after the PCSV has closed, is equal to or greater than the first predetermined value.

7. The method of claim 6, wherein the evaporation gas remaining signal is derived by comparing a value obtained by subtracting an (exhaust gas recirculation) EGR gas amount from the amount of air with an effective intake system volume.

8. The method of claim 5, wherein the evaporation gas remaining signal is derived based on a delay time derived from a delay model function modeling the flow until the evaporation gas has flowed from the intake pipe to an intake manifold and a density of the evaporation gas.

9. The method of claim 5, wherein the evaporation gas remaining signal is derived based on a delay time derived from a delay model function modeling the flow until the evaporation gas has flowed from the intake pipe to an intake manifold and concentration factors of the evaporation gas.

10. A method for removing residual purge gas in operating an active purge system, the method comprising:

determining an evaporation gas purge stop;

closing a PCSV (pressure control solenoid valve) mounted on a purge line connecting a canister and an intake pipe;

determining whether all evaporation gas flowed into the intake pipe through the PCSV has flowed into a combustion chamber when an amount of an air supplied to the combustion chamber after the PCSV is closed is equal to or greater than a first predetermined value or when a time elapsed after the PCSV is closed exceeds a second predetermined value, the determining being based on an evaporation gas remaining signal; and stopping an engine when it is determined that all evaporation gas has flowed into the combustion chamber, wherein the PCSV is ready to operate again after a predetermined critical time has elapsed after it is determined that all of the evaporation gas has flowed into the combustion chamber.

11. The method of claim 10, wherein an active purge pump is mounted on the purge line so as to be located between the PCSV and the canister, the method further comprising adjusting a rotation speed of the active purge pump, an opening amount of the PCSV and an opening and closing timing of the PCSV.

12. The method of claim 11, wherein the adjusting is based on signals received from a sensor mounted on the canister, a sensor mounted on the intake pipe, a sensor mounted on an exhaust pipe connected with the combustion chamber, and a plurality of sensors mounted on the purge line.

13. The method of claim 10, wherein the evaporation gas remaining signal is derived by comparing whether an amount of an air supplied to the combustion chamber after the PCSV has closed, is equal to or greater than the first predetermined value.

14. The method of claim 13, wherein the evaporation gas remaining signal is derived by comparing a value obtained by subtracting an (exhaust gas recirculation) EGR gas amount from the amount of air with an effective intake system volume.

15. The method of claim 10, wherein the evaporation gas remaining signal is derived based on a delay time derived from a delay model function modeling the flow until the evaporation gas has flowed from the intake pipe to an intake manifold and a density of the evaporation gas.

16. The method of claim 10, wherein the evaporation gas remaining signal is derived based on a delay time derived from a delay model function modeling the flow until the evaporation gas has flowed from the intake pipe to an intake manifold and concentration factors of the evaporation gas.

17. The method of claim 5, wherein an active purge pump is mounted on the purge line so as to be located between the PCSV and the canister, the method further comprising adjusting a rotation speed of the active purge pump, an opening amount of the PCSV and an opening and closing timing of the PCSV.

18. The method of claim 17, wherein the adjusting is based on signals received from a sensor mounted on the canister, a sensor mounted on the intake pipe, a sensor mounted on an exhaust pipe connected with the combustion chamber, and a plurality of sensors mounted on the purge line.

* * * * *